US006367910B1

(12) United States Patent
Sette et al.

(10) Patent No.: US 6,367,910 B1
(45) **Date of Patent: *Apr. 9, 2002**

(54) MULTIPLE INLINE PRINT HEAD WITH SERVO DRIVEN MECHANICAL INTERLOCKED PRINT HEAD ASSEMBLIES

(75) Inventors: Paul R. Sette, Branford; Richard A. Sloan, Jr., Southbury, both of CT (US)

(73) Assignee: Pitney Bowes Inc., Stamford, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/716,978

(22) Filed: Nov. 20, 2000

(51) Int. Cl.[7] ..... B41J 23/00
(52) U.S. Cl. ..... 347/37; 400/630
(58) Field of Search ..... 347/37, 42, 43, 347/101; 400/82, 630, 642, 323

(56) References Cited

U.S. PATENT DOCUMENTS 5,192,141 A * 3/1993 Chung et al. ..... 400/56
5,428,375 A * 6/1995 Simon et al. ..... 347/12
5,670,995 A * 9/1997 Kupcho et al. ..... 347/5
6,139,206 A * 10/2000 Ahn ..... 400/323
6,244,688 B1 * 6/2001 Hickman ..... 347/43

* cited by examiner

*Primary Examiner*—Anh T.N. Vo
(74) *Attorney, Agent, or Firm*—Ronald Reichman; Angelo N. Chaclas

(57) ABSTRACT

A method and a printer for printing on a substrate with a plurality of print head assemblies, wherein each assembly includes at least one print head. The printer includes a roller assembly to move the substrate towards the print head assemblies along a feed path, which is substantially perpendicular to the width of the substrate. A movable fence is used to adjust the width of the feed path according to the width of the substrate. A linking arm is used to mechanically couple the print head assemblies with pivot action. A motor/belt assembly is used to move the print head assemblies relative to each other via the linking arm in order to place the printer assemblies over the width of the feed path. Moreover, the printer also comprises a photosensing device coupled to the linking mechanism such that the photosensing device provides a signal when the print head assemblies have been properly place in the feed path according to the width of the feed path.

11 Claims, 5 Drawing Sheets

MULTIPLE INLINE PRINT HEAD WITH SERVO DRIVEN MECHANICAL INTERLOCKED PRINT HEAD ASSEMBLIES

CROSS REFERENCE TO RELATED APPLICATIONS

Reference is made to Application Ser. No. 09/716,979, entitled IN-LINE PRINTER WITH AUTOMATIC POSITIONING MULTIPLE MICROPROCESSOR CONTROLLED PRINT HEADS, assigned to the assignee of this application and filed on even date herewith.

Reference is made to Application Ser. No. 09/716,982, entitled MULTIPLE INLINE PRINT HEAD MANUALLY POSITIONED WITH MECHANICALLY INTERLOCKED PRINT HEAD ASSEMBLIES, assigned to the assignee of this application and filed on even date herewith.

TECHNICAL FIELD

The present invention relates generally to in-line printers and deals more specifically with an in-line printer having automatic positioning multiple assemblies of print heads.

BACKGROUND OF THE INVENTION

In-line configured printers are important because they minimize the length (along the substrate or printing medium) of the print zone, and thereby minimize the overall envelope of the printing machine. Accommodating a longer print zone expands the overall printing machine envelope, which is critical to cost, weight, installation space, inventory and shipping. In-line printers, particularly in-line printers for printing indicia, return address, destination address and/or destination barcode together with optional message line and/or destination barcode on a substrate such as a mail piece, use multiple spaced assemblies of print heads to carry out the required printing.

The positioning of the print head assemblies in such in-line printers is typically accomplished by manual movement of the assemblies with respect to one another in those in-line printers that have movable print head assemblies and after such manual location are then locked in a fixed location. The position of the various areas of information to be printed are located relative to one another with variable spacing depending upon the width of the printing medium material, such as, for example, a print stock postal card, an envelope such as a #10 business envelope, a 10"×13" flat mailing envelope or custom-sized envelope, to be printed. In such in-line printers, a first multiple print head assembly is located to print in a fixed print area of the substrate as the substrate passes relative to the print head. The first multiple print head assembly may be aligned and located to print in a fixed print area that, for example, may be in the print area that includes the return address or other indicia information. A second multiple print head assembly is located relative to the first print head assembly and positioned to print in a second print area, which may include, for example, the destination address and/or destination barcode. A third multiple print head assembly is located and positioned relative to the second and first multiple print head assemblies and located to print in a third print area, which may include, for example, a message line or optional barcode. The location of the first, second and third print areas on a mail piece are within predetermined areas of the mail piece and are typically specified by United States Postal Service standards to accommodate mechanized mail processing for each of the differently sized mail pieces. When a user desires to print with an in-line printer on a differently sized substrate or mail piece, the print head assemblies must be repositioned and located and locked in a different position to meet the location print area requirements for the size of the mail piece being printed.

In-line printers such as those described above require operator intervention to relocate and reposition the multiple print heads each and every time a differently sized mail piece is printed. The operation and set-up of such in-line printers is labor intensive and cumbersome and less than satisfactory. In addition, the continual resetting and repositioning of the print head assemblies relative to one another may lead to positional error and requires constant verification that the print head assemblies are positioned and located properly to meet the addressing standards for the given size mail piece.

Accordingly, it would be desirable and advantageous to provide an in-line printer having a print head assembly that is automatically positionable to print on each of the desired print areas as the substrate and print head assembly move relative to one a another to print in each of the predetermined print areas of a mail piece.

SUMMARY OF THE INVENTION

The present invention substantially obviates, if not entirely eliminates, the disadvantages and shortcomings of in-line printers having multiple spaced-apart print head assemblies that require positioning relative to one another to print in predetermined print areas on a substrate such as a mail piece. The invention accomplishes this by providing an in-line printer having a plurality multiple print head assemblies coupled to a linking mechanism and placed by a motor/belt assembly to properly cover the width of the substrate.

The present invention is an in-line printer for printing on a substrate. The in-line printer comprises several elements which include: a plurality of print head assemblies, each assembly including at least one print head; a first moving mechanism capable of moving the substrate towards the print head assemblies along a feed path in a feed direction, which is substantially perpendicular to the width of the substrate; a linking mechanism for linking the print head assemblies in order to simultaneously place the print head assemblies over a distance; and a second moving mechanism for moving the print head assemblies relative to each other via said linking mechanism in a moving direction substantially parallel to the width of the substrate.

Preferably, the in-line printer further comprises a movable fence for guiding the substrate along the feed path, wherein the movable fence is capable of adjusting a width of the feed path according to the width of the substrate, wherein the linking mechanism is coupled to the fence so that the print head assemblies are placed according to width of the feed path.

Additionally, in a preferred embodiment, the in-line printer further comprises a photosensing device coupled to the linking mechanism such that the photosensing device provides a signal indicative of the linking mechanism having properly placed the print head assemblies according to the width of the feed path, wherein the first moving mechanism is allowed to move the substrate towards the print assemblies in order for the print head to print on the substrate when the signal is provided. The in-line printer further comprises a plurality of guide rails, oriented in a direction substantially parallel to the width of the substrate, for slideably mounting the print head assemblies so as to allow the print head assemblies to move relative to each other along the moving direction. Additionally, each print head assembly has a pin and the linking mechanism has a linking arm including thereon an aperture and at least one slot, wherein the aperture and the slot are engaged with the pins for controlling the placement of the print head assemblies. Preferably, one of the print head assemblies is fixedly mounted relative to the second moving mechanism.

A second aspect of the present invention is a method of in-line printing for printing on a substrate material within a plurality of printing bands, wherein the substrate material has a width and wherein the printing bands are distributed in a predetermined manner over the width. The method comprises the steps of: feeding the substrate material from a feed area into a print area along a feed direction substantially perpendicular to the width; providing a plurality of print-head assemblies in the print area; mechanically linking the print-head assemblies in order to simultaneously place the print-head assemblies over a distance; and providing means to move the print-head assemblies relative to each other via the linking means along a moving direction substantially perpendicular to the feed direction in order to place the print head assemblies over the printing bands.

Preferably, the method further comprises the step of providing a photosensing assembly to indicate when the moving means has properly placed the print head assemblies over the printing bands.

The present invention will become more apparent from an understanding of the following detailed description of the preferred embodiment of the present invention when considered in conjunction with the accompanying drawings.

DETAILED DESCRIPTION

Figure 1A:
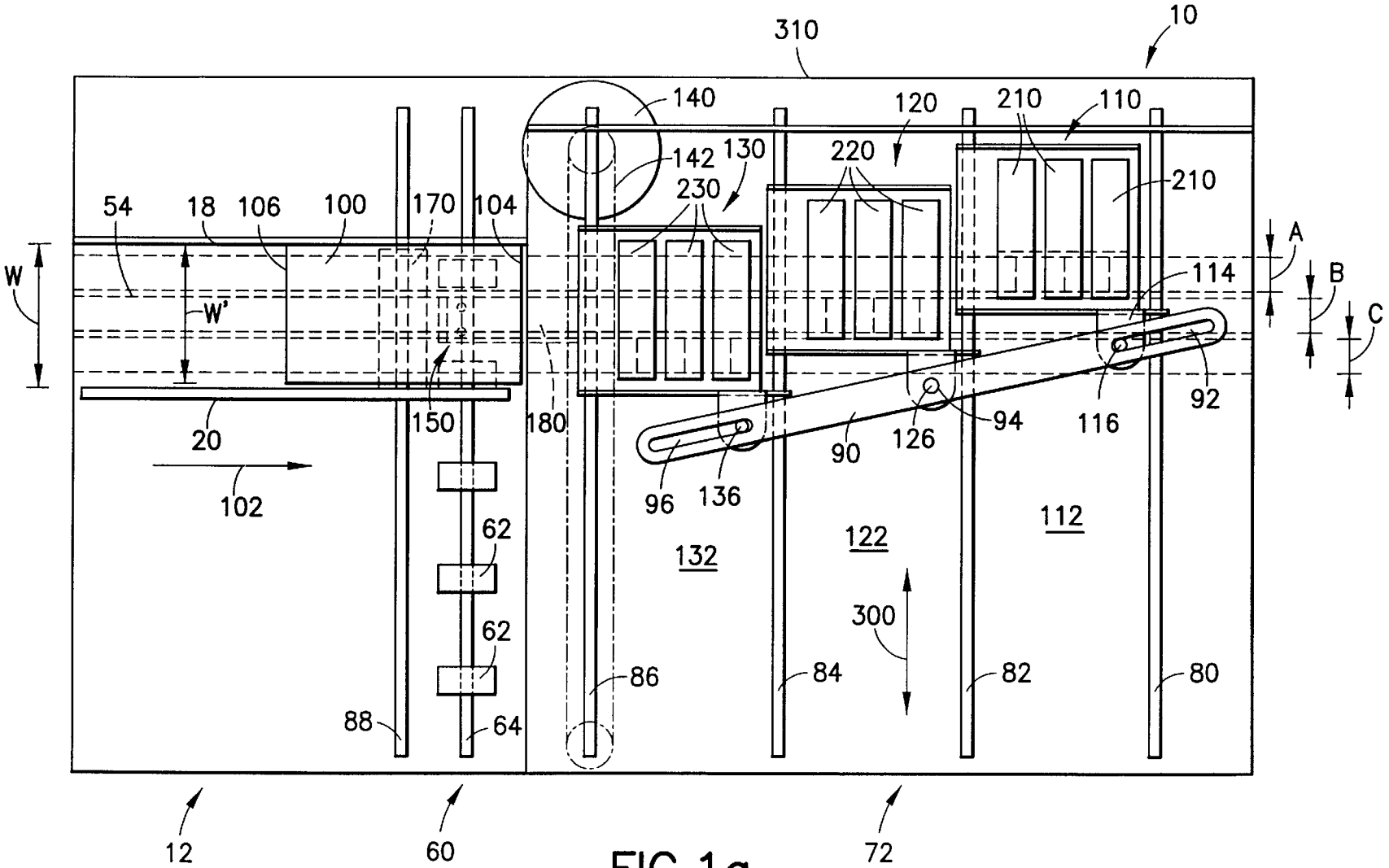
FIG. 1*a* is a diagrammatic representation illustrating a linking mechanism and a motor for ping the print head assemblies for printing on a small substrate.
Figure 1B:
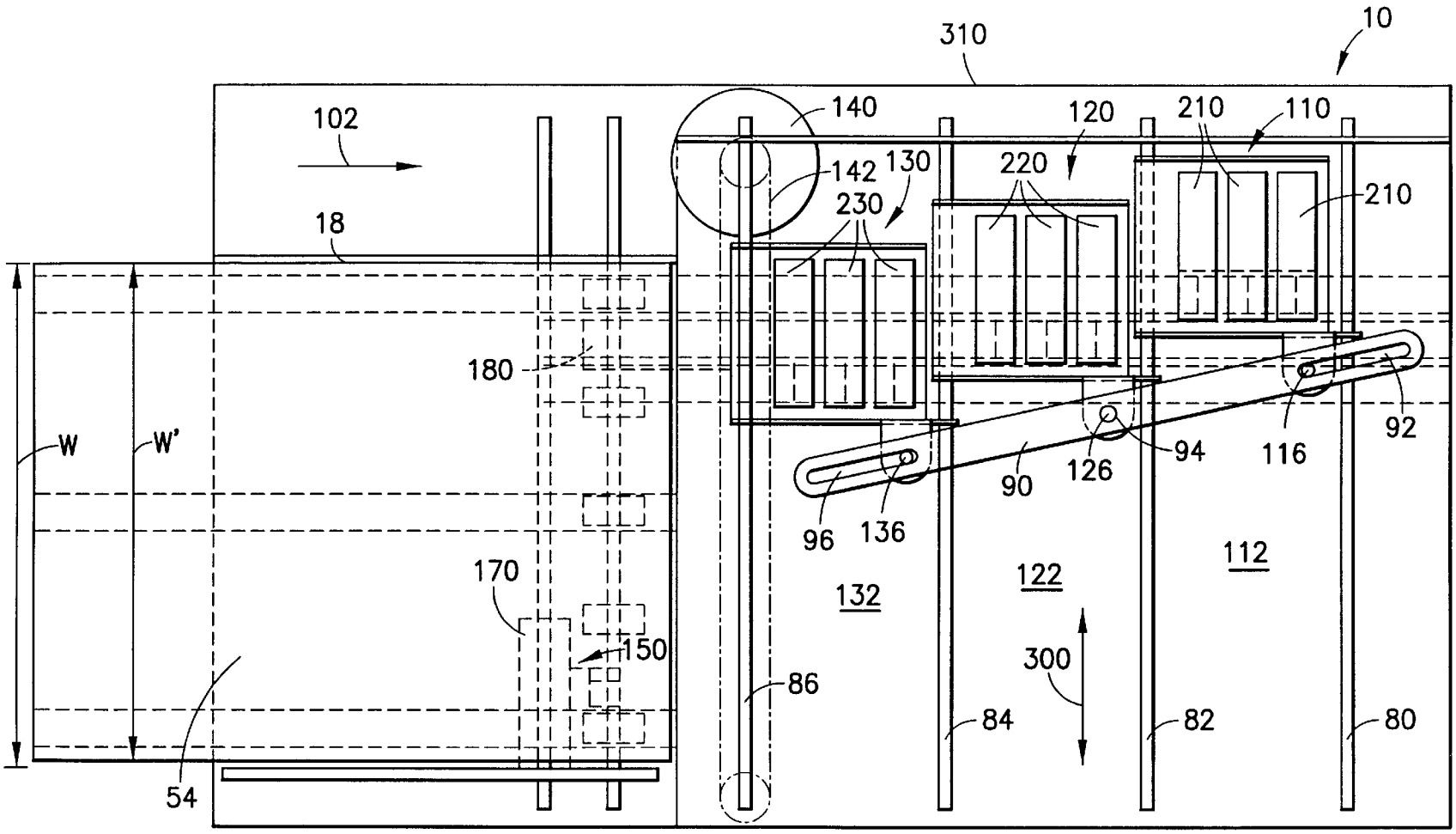
FIG. 1*b* is a diagrammatic representation illustrating a linking mechanism and a motor in the process of placing the print head assemblies for printing on a small substrate.
Figure 1C:
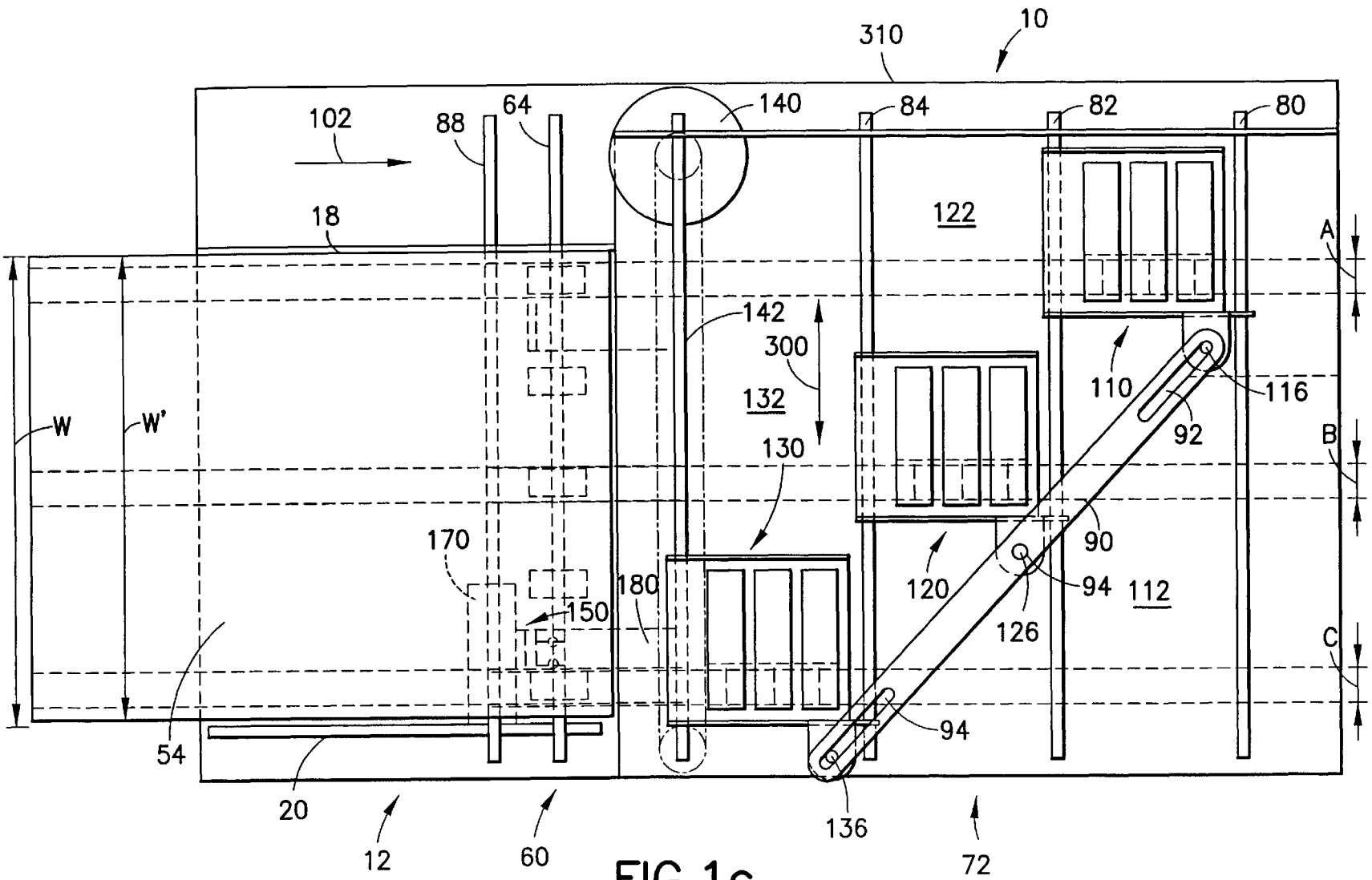
FIG. 1*c* agrammatic representation illustrating a linking mechanism and a motor for placing the print head assemblies for printing on a large substrate.

In FIGS. 1*a*–1*c*, a diagrammatic representation of a top view of a feeding/printing area embodying the present invention is illustrated and generally designated 10. The feeding/printing area 10 includes a material feed area generally designated 12 where the substrate material 100 or printing medium to be fed and printed upon is stacked for feeding to the in-line printer. As shown, an adjustable material fence 20 can be moved closer to a fixed wall 18 or away from the fixed wall 18 to accommodate the different widths of the substrate material 100. The fixed wall 18 is used to register one edge of the substrate material. A substrate material feed roller assembly, generally designated 60, includes a number of spaced-apart feed rollers 62 which are mounted on a roller drive shaft 64 mounted transverse to the direction of substrate material feed direction 102. The roller drive shaft 64 may be rotated by a gear belt or other drive means well known to those skilled in the art of substrate material feed assemblies. The material feed roller assembly 60 is driven in a timed manner to feed the substrate material 100 along a feed path 54 into the print head area 72 to and past one or more print zones each having one print head assembly and each print head assembly has at least one print head. As shown in FIGS. 1*a* and 1*b*, print head assemblies 110, 120 and 130 are, respectively, located in print zones 112, 122 and 132. The print head assembly 110 has three print heads 210 capable of printing on a swath A. Likewise, the print head assembly 120 has three print heads 220, capable of printing on a swath B, and the print head assembly 130 has three print heads 230, capable of printing on swath C. A linking arm 90 has an aperture 94 and two slots 92, 96 to provide mechanical coupling to the print head assemblies 110, 120 and 130. A plurality of parallel guide rails 80, 82, 84 and 86 are used to slideably mount the print head assemblies 110, 120 and 130, allowing some or all of these print head assembly to move along a direction 300 which is substantially perpendicular to the feed direction 102. For example, the print head assembly 130 has a plate 134 including a pin 136 to engage with the slot 96. Likewise, the print head assembly 120 has a plate 124 including a pin 126 to engage with the aperture 94, and the print head assembly 110 has a plate 114 having a pin 116 is used to engage with the slot 92. A motor 140 and an endless belt 142 are used to move the print head assembly 130 along the guide rail 86. Preferably, the motor 140 is a servo motor or a stepping motor. Preferably, the print head assembly 110 is fixedly mounted so that the print heads 210 are used to cover the swath A, which is closest to the fixed wall 18. When the print-head assembly 130 is moved by the motor 140 along the moving direction 300, the print-head assembly 120 will also be moved along the same direction by the linking arm 90 with the pivot action at the pins 116, 126 and 136. Thus, the motor 140 moves the print-head assemblies 110, 120 and 130 relative to each other along the moving direction 300, and the linking arm 90 simultaneously places the print-head assemblies 110, 120 and 130 in the print-head area 72.

FIG. 1*a* illustrates the placement of the print head assemblies 110, 120 and 130 when a small substrate 100 is fed through the feed path 54 for printing. As shown, the material fence 20 has been moved towards the fixed wall 18 so that the width W of the feed path 54 is substantially equal to the width W' of the substrate 100. In that case, all the print head assemblies are moved towards the left edge 310 of the feeding/printing area 10 so that the swaths A, B and C evenly cover the width W' of the substrate 100. In FIG. 1*a*, the width W' of the substrate is about 3 inches (7.62 cm), for example.

When printing a large substrate, such as the substrate 100' shown in FIGS. 1*b* and 1*c*, the material fence must be moved away from the fixed wall 18 in order to widen the feed path 54. With the large substrate 100', it is possible to space the print head assemblies apart along the direction 300 away from the left edge 310. In FIGS. 1*b* and 1*c*, the width W' of the substrate is about 10 inches (25.4 cm), for example.

To properly position an assembly of print heads for printing in the desired designated print areas of the substrate material, it is necessary to know the size of the substrate material to be printed upon. This identification process is accomplished in the present invention by first adjusting the width W of the feed path 54 according to the width W' of the substrate by adjusting the position of the adjustable material fence 20, as shown in FIG. 1*b*. The print-head assemblies 110, 120 and 130 are then driven along the moving direction 300 until they properly cover the width W of the feed path 54, as shown in FIG. 1*c*.

In the preferred embodiment of the in-line printer, as illustrated in FIGS. 1*a*–1*c*, a photosensing assembly 150 is used to indicate the width W' of the feed path 54. As shown, the photosensing assembly 150 is fixedly mounted on a mounting device 170, which is attached to the adjustable material fence 20. An interrupter plate 180, fixedly mounted on the print-head assembly 130, is moved along with the print-head assembly 130 in order to automatically locate the photosensing assembly 150. The photosensing assembly 150 is described in details in conjunction with FIGS. 2*a*–2*c* below. It can be designed such that only when the interrupter plate 180 is properly aligned with the photosensing assembly 150, as shown in FIGS. 1*a* and 1*c*, the print-heads 210, 220 and 230 are allowed to print on the substrate material 100. It is also possible that the feed roller assembly 60 is allowed to move the substrate material 100 into the print-head area 72 for printing, only when the interrupting plate 180 is properly aligned with the photosensing assembly 150.

Figure 2A:
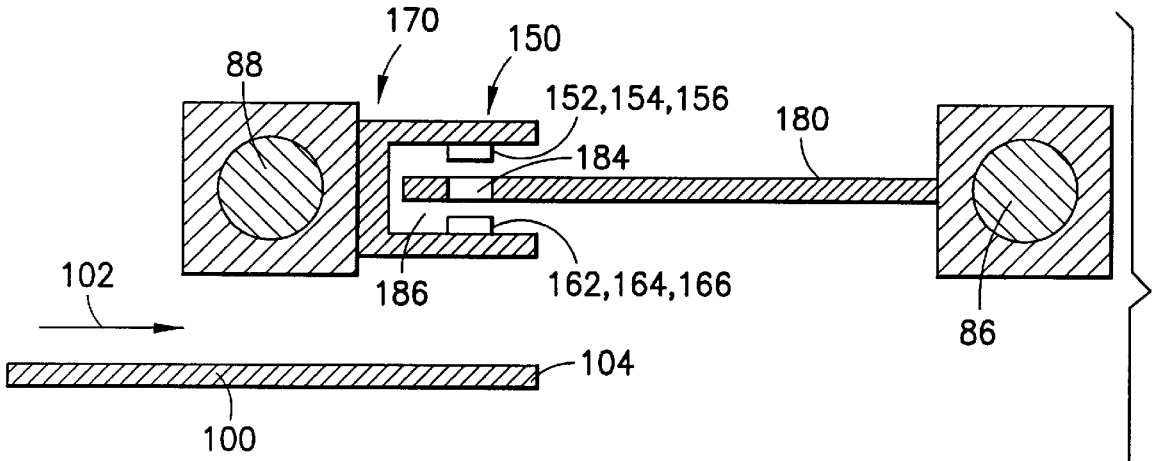
FIG. 2*a* is a diagrammatic side view representation illustrating a photosensing assembly and an optical interrupter.
Figure 2B:
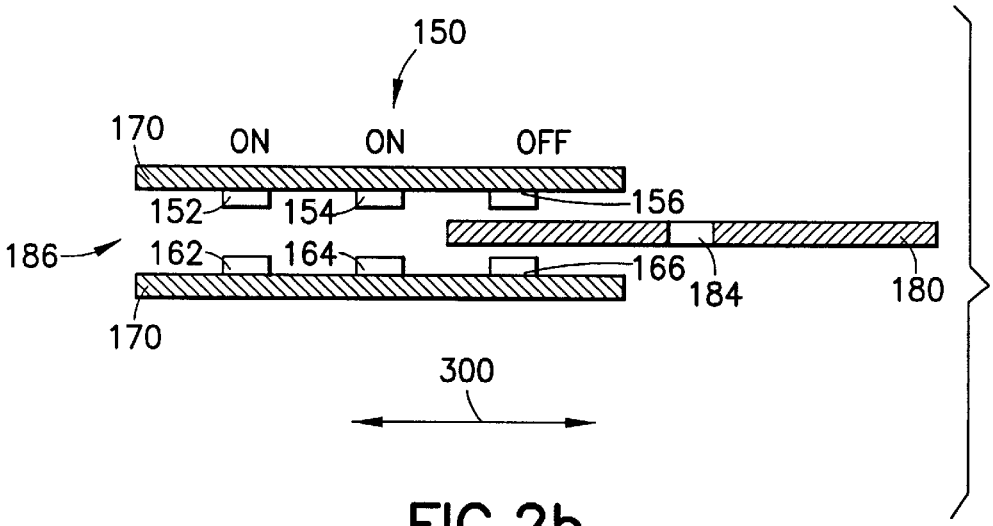
FIG. 2*b* is a diagrammatic front view representation illustrating the optical interrupter being partially aligned with the photosensing assembly.
Figure 2C:
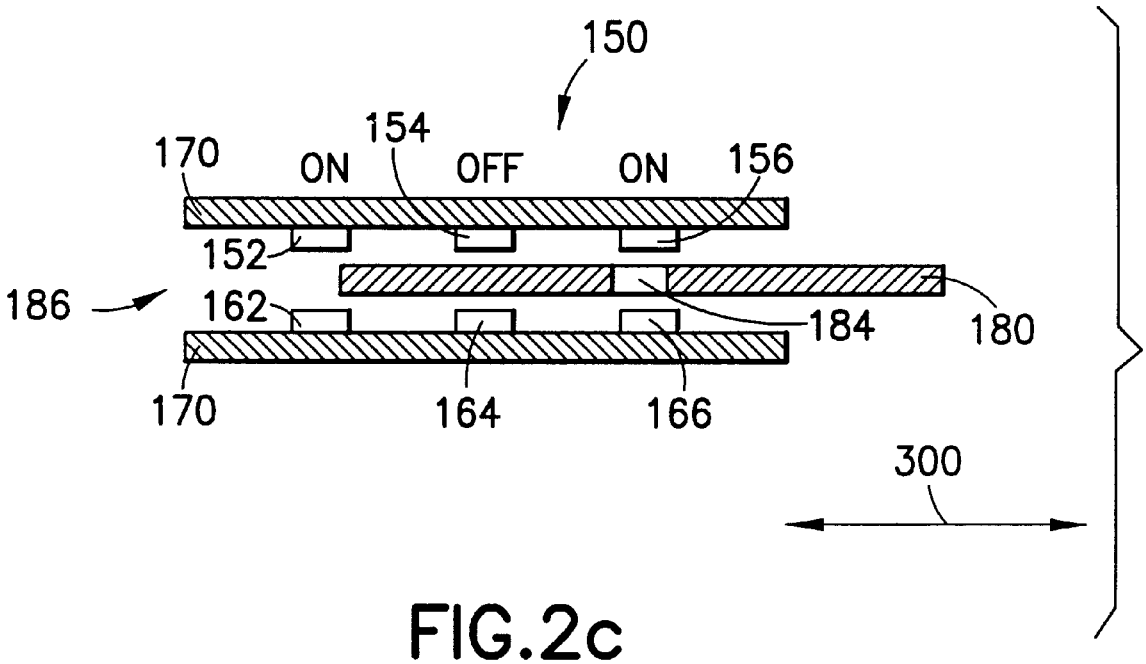
FIG. 2*c* is another diagrammatic front view representation illustrating the optical interrupter being partially aligned with the photosensing assembly.
Figure 2D:
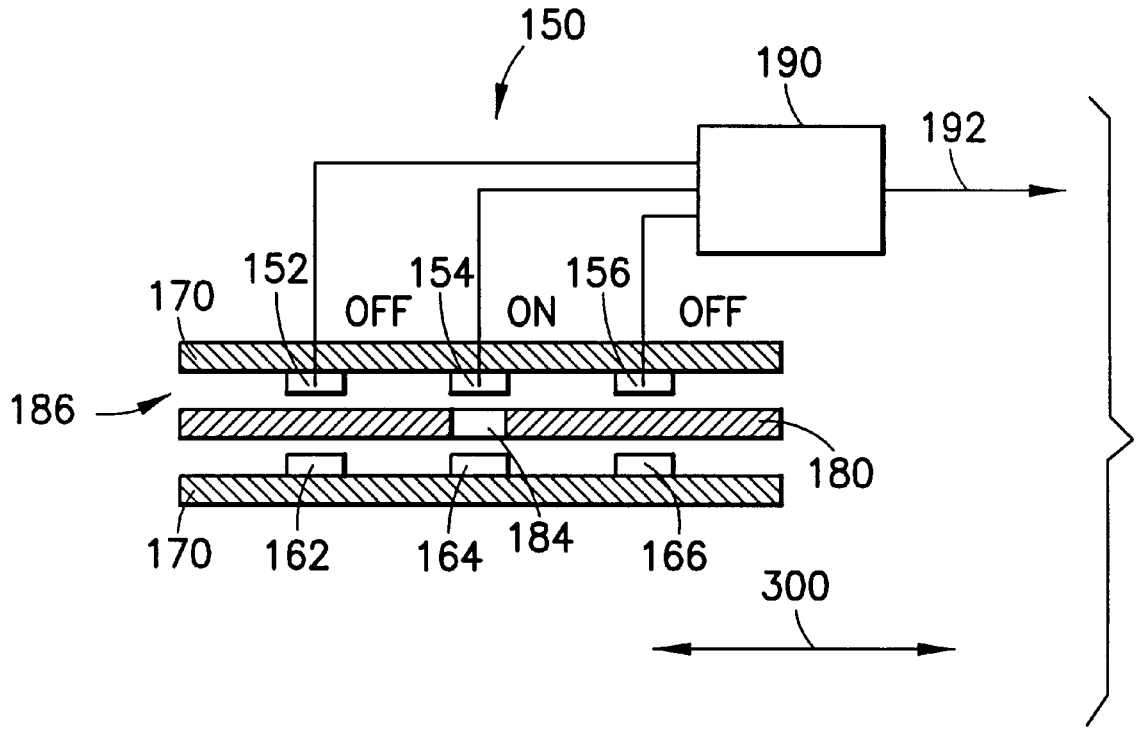
FIG. 2*d* is a diagrammatic front view representation illustrating the optical interrupter being properly aligned with the photosensing assembly.

FIGS. 2*a* to 2*d* illustrate the principle of using the interrupter plate 180 to locate the photosensor assembly 150. It is possible to mount three photosensor/emitter pairs 152/162, 154/164 and 156/166 on the mounting device 170. Each photosenor is capable to receive light emitted by the corresponding emitter, when the emitted light is not blocked by the interrupter 180. The interrupter plate 180, which has only one aperture 184, can be moved into a gap 186 between the sensors 152, 154, 156 and the emitters 162, 164, 168 in order to prevent the light emitted by some of the emitters 162, 164, 166 from reaching the corresponding sensors 152, 154, 156, as shown in FIG. 2*a*. For example, when they are not blocked by the interrupter plate 180, the sensors 152, 154 can see the light produced by the emitters 162, 164 and the sensors 152, 154 are said to be operated at an ON state, as shown in FIG. 2*b*. The sensor 156 is operated at an OFF state because it cannot not see the light emitted from the correspond emitter 166. When the interrupter plate 180 moves further into the gap 186, the sensors 152, 156 can see the light produced by the emitters 162, 166, but the sensor 154 cannot see the light from the emitter 164. Thus, the emitters 152, 154, 156 are respectively operated at ON, OFF, ON states, as shown in FIG. 2*c*. Thus, only when the interrupter plate 180 is substantially aligned with the photosensing assembly 150, the transceivers 152, 154 and 156 are, respectively, operated at the OFF, ON, OFF state, as shown in FIG. 2*d*. When the interrupter plate 180 is substantially aligned with the photosensing assembly 150, as shown in FIG. 2*d*, the operating states of the emitters 152, 154, 156 are OFF, ON, OFF. When this happens, it is possible to provide a signal 192 by an electronic device 190 to indicate a proper alignment. After the signal 192 is provided, the feed roller assembly can move the substrate material 100 into the print-head area 72 for printing.

Similarly, photoemitters and photosensors can be used to sense the leading edge 104 and the trailing edge 106 of the substrate material 100. Because the substrate material 100 can be fed in a timed movement from the feed area 52 into the print-head area 72, it is possible to use the photo-transceivers to detect a jam or a "material out" situation. Furthermore, since the substrate material 100 is moving with a known speed, it is possible to use a control software to control the timing for the print-head 210, 220 and 230 to print at the proper section of the substrate material 100.

For purposes of this disclosure, the substrate material 100 is shown with a first band or a fixed print areas, generally designated as swath A, in which typically the return address or other indicia information is printed. A second print area or band, generally designated as swath B, contains the destination address and destination barcode if one is so used. A third or bottom print area or band, generally designated as swath C, is used to print a message line or optional barcode. The location of the three print areas or bands are predetermined and set in accordance with the standards set by the United States Postal Service.

Each of the print heads includes one or more inkjet nozzles. The nozzles can be arranged to form a stepped or staircase-like arrangement whereby a greater surface area can be printed as the substrate material is moved from the feed area into the different print zones of the print-head area. The inkjet nozzles of the print heads are operated and controlled via the control software in a manner well known to those skilled in the art of ink jet printing to deposit or not deposit ink on the substrate surface as required to generate the desired text, graphics or other indicia within the designated print areas. Typically, the ink is black although any color can be used.

In some instances, it is also desirable to print a second color within the designated print areas. In that case, it is possible to use one or more multi-color ink cartridges in each print head assembly. It is also possible to use a number of different, single color ink cartridges in a print head assembly.

As can be appreciated by those skilled in the printer art, a number of variations of the subject invention are possible. These variations include, but are not limited to, the number of print areas controllable on the substrate, the number of successive print head assemblies that may be utilized, the addition of sensors to the adjustable material fence to operate in conjunction with the photo-optic sensors for detecting the leading and trailing edges of a substrate and the variations in the substrate material feed bin and feeding mechanisms to the printer.

It is to be understood that the present invention is not to be considered as limited to the specific embodiments described above and shown in the accompanying drawings, which merely illustrate the best mode presently contemplated for carrying out the invention and which is susceptible to such changes as may be obvious to one skilled in the printing art, but rather that the invention is intended to cover all such variations, modifications and equivalents thereof as may be deemed to be within the scope of the claims appended hereto.

What is claimed is:

1. An in-line printer for printing on a substrate having a width, said printing comprising:

(a) a plurality of print head assemblies, each assembly including at least one print head;

(b) a first moving mechanism capable of moving the substrate towards the print head assemblies along a feed path in a feed direction substantially perpendicular to the width of the substrate;

(c) a linking mechanism for linking the print head assemblies in order to simultaneously place the print head assemblies over a distance; and (d) a second moving mechanism for moving the print head assemblies relative to each other via said linking mechanism in a moving direction substantially parallel to the width of the substrate.

2. The in-line printer of claim 1, further comprising a fence for guiding the substrate along the feed path, wherein said fence is capable of adjusting a width of the feed path according to the width of the substrate, wherein the linking mechanism is coupled to the fence so that the print head assemblies are placed according to width of the feed path.

3. The in-line printer of claim 2, further comprising a photosensing device coupled to the linking mechanism such that the photosensing device provides a signal indicative of the linking mechanism properly placing the print head assemblies according to the width of the feed path, wherein the print heads are allowed to print on the substrate when the signal is provided.

4. The in-line printer of claim 3, wherein the first moving mechanism is allowed to move the substrate towards the print assemblies when the signal is provided.

5. The in-line printer of claim 1, further comprising a plurality of guide rails oriented in a direction substantially parallel to the width of the substrate, for slideably mounting the print head assemblies so as to allow the print head assemblies to move relative to each other along the moving direction.

6. The in-line printer of claim 1, wherein the second moving mechanism comprises a motor.

7. The in-line printer of claim 1, wherein the first moving mechanism comprises a plurality of rollers.

8. The in-line printer of claim 1, wherein each print head assembly has a pin and the linking mechanism has a linking arm including an aperture and at least one slot, and wherein the aperture and the slot are engaged with the pins for controlling the placement of the print head assemblies.

9. The in-line printer of claim 1, wherein one of the print head assemblies is fixedly mounted relative to the second moving mechanism.

10. A method of in-line printing for printing on a substrate material within a plurality of printing bands, wherein the substrate material has a width and wherein the printing bands are distributed over the width, said method comprising the steps of:

(a) providing means to feed the substrate material from a feed area into a print area along a feed direction substantially perpendicular to the width;

(b) providing a plurality of print-head assemblies in the print area;

(c) providing means for mechanically linking the print-head assemblies in order to simultaneously place the print-head assemblies over a distance; and (d) providing means to move the print-head assemblies relative to each other via the linking means along a moving direction substantially perpendicular to the feed direction in order to place the print head assemblies over the printing bands.

11. The method of claim 10, further comprising the step of providing a photosensing assembly to indicate when the moving means has properly placed the print head assemblies over the printing bands.

* * * * *